United States Patent [19]

Friedman

[11] Patent Number: 4,592,415

[45] Date of Patent: Jun. 3, 1986

[54] THIN FLAT HEAT EXCHANGER AND METHOD OF MAKING SAME

[76] Inventor: Howard Friedman, 9321 Menard, Morton Grove, Ill. 60053

[21] Appl. No.: 659,080

[22] Filed: Oct. 9, 1984

[51] Int. Cl.[4] ..... F28F 3/12; H01L 23/40

[52] U.S. Cl. ..... 165/80.5; 165/80.4; 165/170

[58] Field of Search ..... 165/80 C, 80 D, 170

[56] References Cited

U.S. PATENT DOCUMENTS

| | | | |
|---|---|---|---|
| 1,782,234 | 11/1930 | Hoffmann | 165/170 |
| 2,739,047 | 3/1956 | Sanz | 428/598 |
| 4,188,996 | 2/1980 | Pellant et al. | 165/170 X |
| 4,291,681 | 9/1981 | Berringer | 165/170 X |
| 4,467,860 | 8/1984 | Wargo | 165/80 C |

FOREIGN PATENT DOCUMENTS

| | | | |
|---|---|---|---|
| 216186 | 1/1957 | Australia | 165/80 C |

*Primary Examiner*—Sheldon J. Richter

*Attorney, Agent, or Firm*—Dressler, Goldsmith, Shore, Sutker & Milnamow, Ltd.

[57] ABSTRACT

A flat, very thin fluid heat exchanger of up to about ⅛ inch in thickness is formed from a pair of etched blanks. The blanks are provided with at least a pair of projecting tabs for locating the blanks relative to each other. The tabs are secured prior to brazing of the blanks and are thereafter removed. Posts are provided for facilitating securance of the heat exchanger to objects with which it is to be associated. A thin fluid flow passageway is provided between the blanks, and the heat exchanger provides fluid flow inlet and outlet openings communicating with the fluid flow passageway.

3 Claims, 10 Drawing Figures

FIG. 1
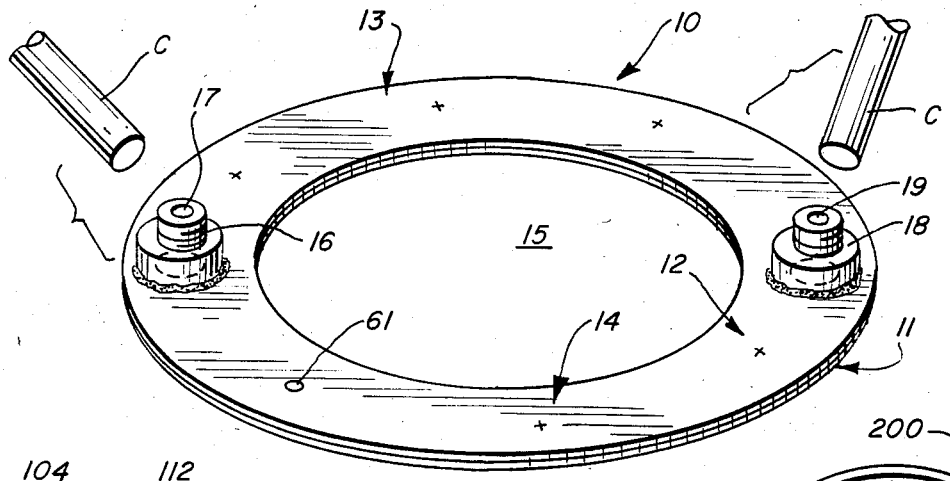
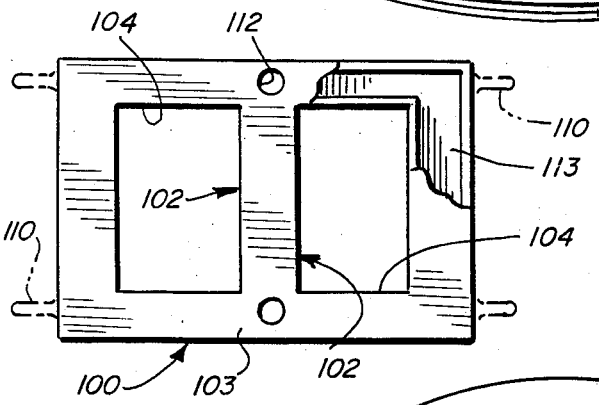
FIG. 9
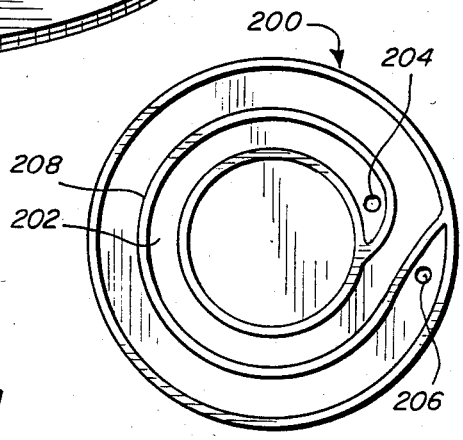
FIG. 10
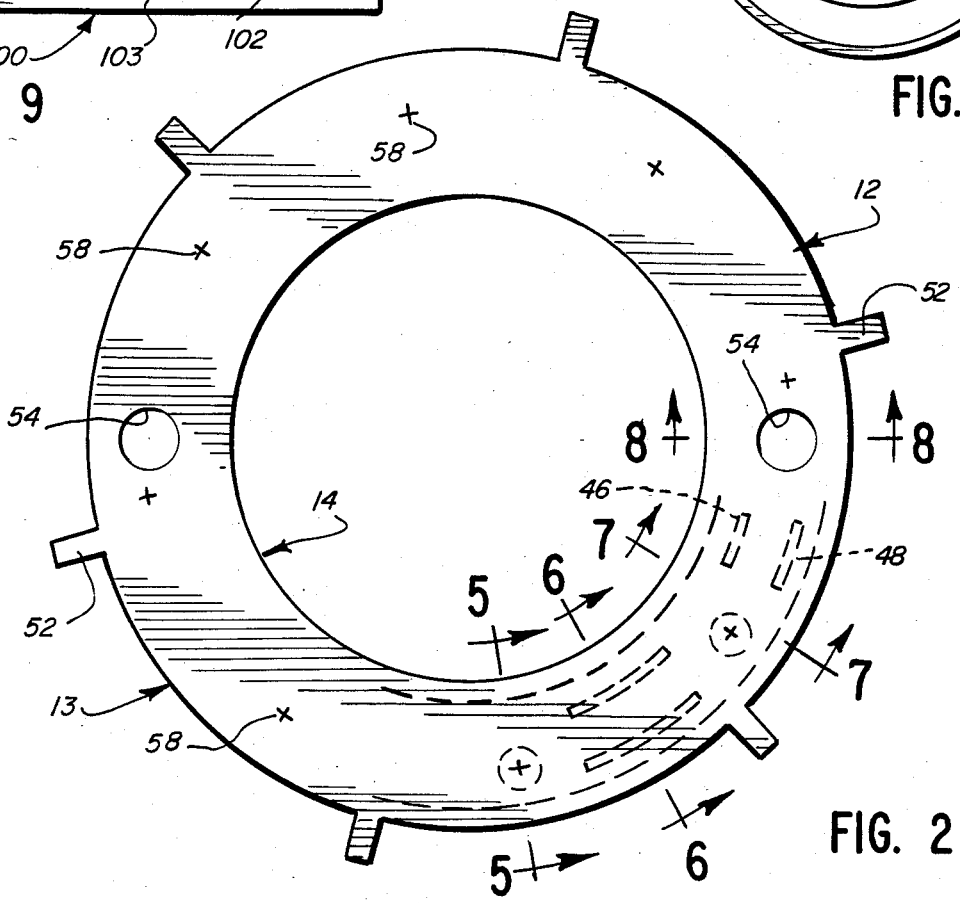
FIG. 2

THIN FLAT HEAT EXCHANGER AND METHOD OF MAKING SAME

BACKGROUND OF THE INVENTION

This invention relates to a fluid heat exchanger, and in particular to a flat, very thin heat exchanger of up to no more than about one eighth inch in thickness. This invention also relates to an improved method for fabricating and assembling a thin, flat heat exchanger which insures its accurate and leaktight characteristics.

It is well known that cooling is necessary to avoid damage to many thermoelectric devices. Fans and various types of heat exchangers are used to effect cooling. There remains, however, a need for improved cooling media, and particularly for use in environments where space is limited and the configuration of the device to be cooled limits the type and nature of heat exchangers which may be used. Micro and mini computers are typical of difficult to cool environments, particularly for some zones of the computers. The thin, flat, compact and efficient heat exchanger of the present invention is adapted for uses in existing environments which are not conveniently or readily coolable in an expedient fashion currently.

A variety of heat exchanges and methods for producing such exist in the art including processes which have employed etching techniques to produce them. For example, Little U.S. Pat. No. 4,392,362 discloses a miniature refrigerator in which micron-sized fluid passages are defined in internal surfaces of a laminate by techniques such as etching. Solar collector panels have been formed by etching a pattern of grooves as shown by Benjamin U.S. Pat. No. 4,331,503. Generally flat heat exchangers are shown in Berkowitz et al. U.S. Pat. No. 3,800,868 and a generally flat solar panel having internal passages with peripheral seals is shown in Severenson U.S. Pat. No. 4,161,809. Hopkinson et al. U.S. Pat. No. 3,334,401 shows the etching of channels of desired shape for fluid logic and like systems.

Sanz U.S. Pat. No. 2,739,047 discloses chemically milled structural shapes, such as rocket booster casings and structural panels and the like. Sanz discloses that etched out areas may be desirable for a variety of purposes including forming elongated passages for the conduction of coolant fluid.

However none of the prior art patents discloses a thin flat heat exchanger, as of no more than about one-eighth inch in thickness, in which flat elements defining a passageway are brazed together and which define openings, including an opening for an element of an object to be cooled, nor do the patents disclose a process in accordance with the present invention.

SUMMARY OF THE INVENTION

The present invention provides a thin flat heat exchanger, especially adapted to carry heat away from a thermoelectric device, and which is configured to provide openings which surround elements of the device to be cooled, and which is proportioned so as to be usable in environments where space is at a premium and available room for disposition of a heat exchanger is severely limited.

The present invention also provides an improved method for producing such a thin, flat heat exchanger, such as one which is of a thickness of no greater than about one-eighth inch. The method of making the heat exchanger comprises the steps of providing a first thin, flat metallic blank, photochemically etching the blank to produce a fluid flow recess between peripheral elevated boundaries and to produce locating means, juxtaposing the etched blank with a confronting second thin, flat blank having cooperating confronting locating means with brazing compound in the zone of the boundaries, providing fluid flow openings in at least one of the blanks, securing the locating means of the first and second blanks and then heating the blanks to braze them together, thereby to produce a fluid flow passageway in the zone of the fluid flow recess between the peripheral boundaries, the fluid flow passageway being in flow communication with the fluid flow openings. The boundaries are formed and positioned to surround at least one opening formed in the heat exchanger, so that the heat exchanger may circumscribe an element to be cooled.

Desirably each of the locating means and cooperating locating means comprises at least a pair of projecting tab means positioned in confronting array, and the method comprises the further step of securing confronting tab means prior to brazing, and thereafter removing at least a portion of the tab means. The second blank may also be photochemically etched to produce a second fluid flow recess complementary to the first recess and to produce complementary peripheral elevated boundaries and complementary locating means.

Preferably, each of the locating means and cooperating confronting locating means comprises at least a pair of projecting tabs, and the method comprises the further step of securing the confronting tabs prior to brazing, and thereafter removing at least a portion of the tabs.

Each of the blanks may be photochemically etched to produce at least one complementary post in the zone of the recess, and the method may additionally comprise the step of brazing the posts to produce a fluid tight joint thereat so that the posts are adapted to be drilled for receipt of a fastener to secure the heat exchanger to an assembly to be cooled. One or both blanks may be photochemically etched to produce at least two posts in the recess and a plurality of rib means in the recess between said elevated boundaries and to produce locating means comprising locating tabs projecting outwardly from the blank.

A thin, flat heat exchanger in accordance with the present invention is of a thickness of no more than about one-eighth inch and comprises a flat photochemically etched first thin, flat element having a first surface defining elevated first peripheral boundary portions surrounding a first etched-out recess, a second thin, flat element confronting the first element which is sealingly secured as by brazing to the first peripheral boundary portions to define a fluid passageway including the first etched-out recess, first and second fluid openings defined by the elements and providing an inlet to, and an outlet from, the passageway, and means integral with at least one of the elements and in contact with the other element located in the passageway for maintaining the skeletal strength of the passageway and the structural integrity of the heat exchanger.

The heat exchanger preferably comprises locating means for locating the first and second elements relative to each other, and for facilitating brazing of the elements to each other. In their preferred form, the locating means comprise complementary tabs integral respectively with each of the elements, and the tabs of the first element are welded to to tabs of the second element.

The integral means for maintaining structural integrity means comprise post means defining a zone in which the heat exchanger may be drilled through without affecting the fluid tight integrity thereof. The integral means may also comprise rib means in the passageway for maintaining the skeletal strength of the passageway.

The heat exchanger may also comprise a photochemically etched second element having a second surface defining elevated peripheral boundary portions surrounding a second etched-out recess, with the first and second peripheral boundary portions being complementary to define a fluid passageway which incudes the first and second etched out recesses, and wherein the integral means includes complementary members projecting towards each other from each of the first and second thin flat elements.

Further objects, features and advantages of the present invention will become apparent from the following description and drawings of presently preferred embodiments of the present invention.

BRIEF DESCRIPTION OF THE DRAWINGS

FIG. 1 is a perspective view of an assembled heat exchanger made in accordance with the present invention;

FIG. 2 is a plan view of the heat exchanger of FIG. 1 in an intermediate state of manufacture.

FIG. 9 is a plan view, partially broken away, of a heat exchanger of a shape different from the heat exchanger of FIGS. 1–8; and FIG. 10 is a plan view of an alternative elements adapted for use in accordance with the present invention, which may be used to provide a multipass or maze-type of passageway.

DETAILED DESCRIPTION

Figure 3:
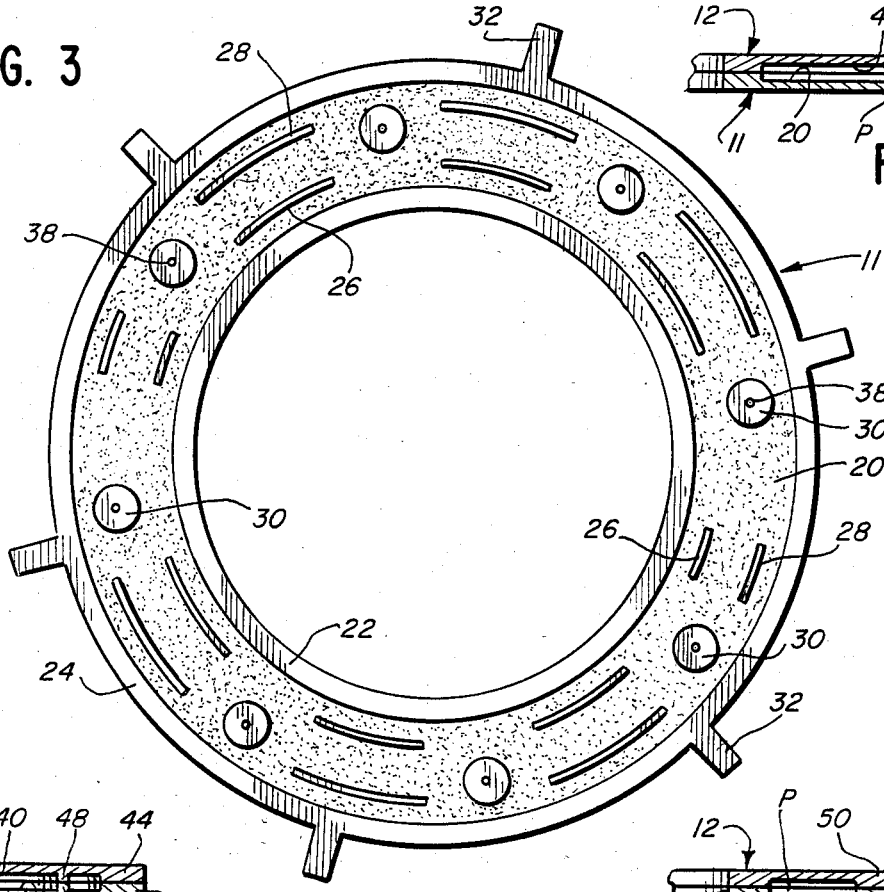
FIG. 3 is a top plan view of one of the elements of which the intermediate of FIG. 2 is made.
Figure 7:
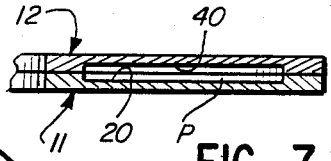
FIG. 7 is a cross-sectional view taken substantially along line 7—7 of FIG. 2.
Figure 6:
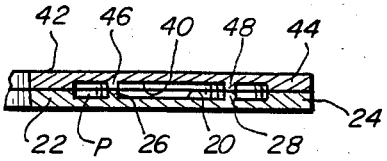
FIG. 6 is a cross-sectional view taken substantially along line 6—6 of FIG. 2.
Figure 5:
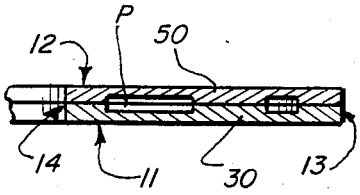
FIG. 5 is, a cross-sectional view taken substantially along line 5—5 of FIG. 2.

Referring now to the drawings, a presently preferred embodiment of an assembled thin, flat heat exchanger 10 of the present invention is shown as having an annular configuration defining a single central opening. The heat exchanger comprises a pair of expansive, thin, flat metallic elements or blanks such as flat annuli 11 and 12 which are sealingly secured as by brazing to provide leaktight peripheries, namely outer periphery 13 and an inner periphery 14 which defines a central circular opening 15. The heat exchanger is flat, and in the form shown, mounts a pair of nipples 16, 18 which are welded in fluid tight fashion to annulus 12 in spaced relation to provide a suitable inlet and outlet to a fluid flow path internally of the heat exchanger.

As seen in greater detail in FIGS. 2–8 inclusive, annulus 11 comprises a shallow annular internal fluid flow recess section 20 in one surface thereof. Section 20 is circumscribed by an annular internal elevated boundary or ledge 22 and an annular external elevated boundary or ledge 24. Additionally, recessed section 20 is provided with spaced projections which extend upwardly to the same elevation as do the ledges 22 and 24. The spaced projections include arcuate rib segments 26, 28 which preferably lie along circles which are concentric with the ledges 22, 24. The projections also comprise a series of spaced posts 30. Finally, annulus 11 includes a plurality of spaced locating means, such as generally radially projecting peripheral locating and fixturing tabs 32. Tabs 32 are of substantially the same thickness as ledges 22, 24 and are coplanar with the upper and lower surfaces of the external ledge 24.

Annulus 12 is generally similar in construction and complementary to annuli 11 and its parts and comprises a shallow annular internal fluid flow recess section 40. Section 40 is bounded by an annular internal ledge 42 and an annular external ledge 44. Additionally, recessed section 40 is provided with spaced projections which extend downwardly to the same elevation as do ledges 42, 44. The spaced projections include arcuate rib segments 46, 48 which desireably lie along circles which are concentric with ledges 42. The projections also comprise a series of spaced posts 50. Annulus 12 also includes a plurality of locating means, such as generally radially projecting peripheral locating and fixturing tabs 52 which are generally coplanar with the upper and lower surfaces of the external ledge 44. Finally, annulus 12 defines a pair of clear-through inlet and outlet fluid flow openings 54 which communicate with recessed section 40 and, after assembly, with the openings 17, 19 in nipples 16, 18, respectively.

As seen in FIGS. 5–8, when the elements or annuli 11, 12 are juxtaposed and assembled, recessed sections 20, 40 define a thin annular passageway P bounded at its external periphery 13 by sealed confronting ledges 24, 44 and at its internal periphery by sealed confronting ledges 22, 42. The passageway P is in flow communication with the openings 17, 19 in the nipples through openings 54. The selected cross-sectional shape and volume of the passageway is maintained by the confronting projections, namely confronting posts 30, 50 and rib segments 26, 46 and 28, 48. Each of these confronting pairs are complementary and are seated on and secured to each other to define a passageway and internal flow path of predetermined volume, shape, cross-sectional configuration and of desired flow characteristics.

As seen in FIG. 2, prior to removal of the locating tabs 32, 52, these also confront and are secured to each other.

Figure 4:
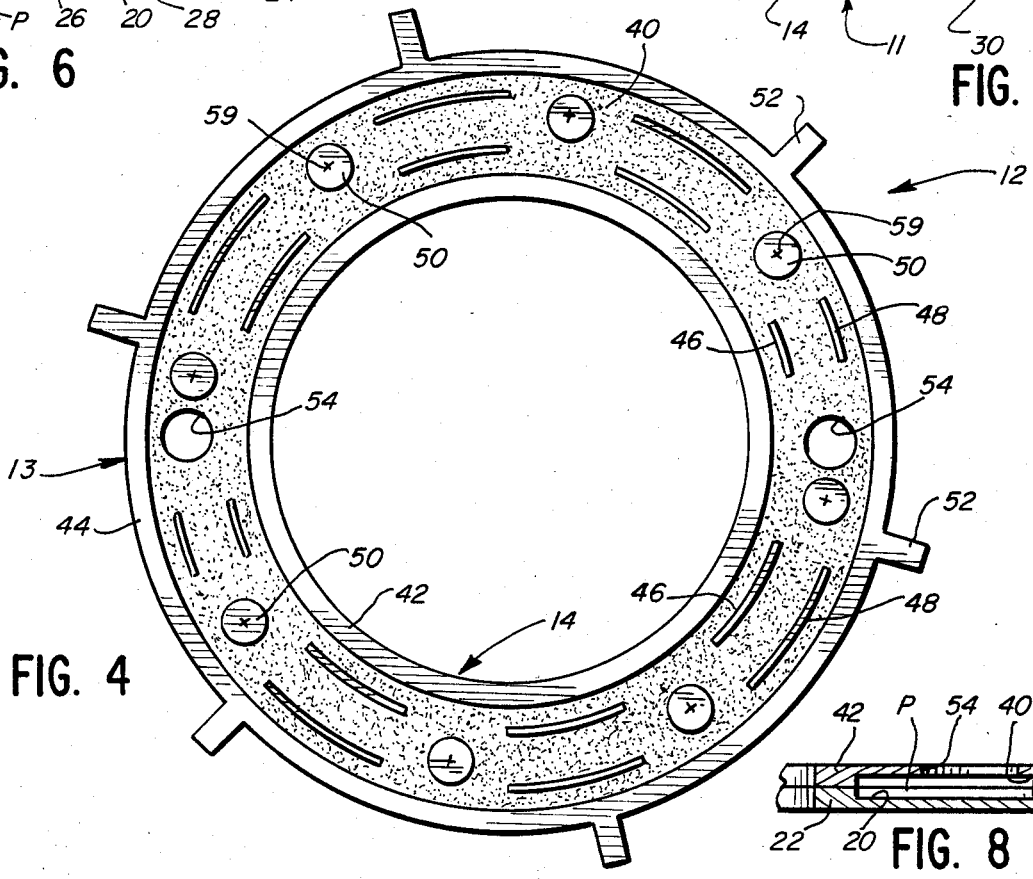
FIG. 4 is a plan view of the other of the elements of which the intermediate of FIG. 2 is made.
Figure 8:
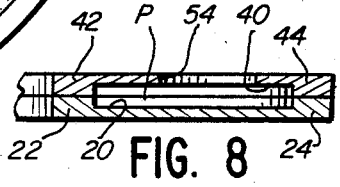
FIG. 8 is a cross-sectional view taken substantially along line 8—8 of FIG. 2.

As seen in FIGS. 1 and 2, a pattern of drilling locators 58, such as cross shaped locators, are provided on the outer surface of annulus 12. These are centrally located relative to posts 50 which bear similar locators 59 (FIG. 4). The centers of the crosses 58, 59 are in line with each other. FIG. 3 shows that the posts 30 define central depressions 38 which are in line with the centers of crosses 58, 59.

When the heat exchanger 10 is completed, it may be desirable to physically secure it in the environment it is to be used. As such, brazed posts 30, 50 may be tapped, drilled or etched centrally to provide openings to receive bolts or screws. Tapping, drilling or otherwise providing openings centrally of the locators 58 and in a zone in which a seal is provided, will assure that no leakage from the heat exchanger will occur. Crosses 59 and depressions 38 are provided as a relief means and as a starter, to facilitate drilling and tapping and to reduce the possibility that the stresses of drilling or tapping will destroy the bond between the faces of posts 30, 50. A typical opening 61 which has been drilled in a post zone and which is adapted to receive a fastener for securing the heat exchanger to an assembly to be cooled is shown in FIG. 1.

Annuli 11, 12 are fabricated photochemically. This facilitates the inexpensive, but highly accurate preparation of precise, thin metal elements in which the ledge thickness is as little as 1/16th inch (0.0625 inch) thick and less.

To that end oversized artwork corresponding to the elements or annuli, and defining recessed sections 20, 40 are prepared. In one form, the artwork is prepared by using drafting type cutting tools to remove portions of a red film which is removeably secured to an underlying transparent polyester film (such as a Mylar film). A suitable red film-Mylar film is available under the name "RUBYLITH" from Ulano Corporation, 255 Butler Street, Brooklyn, N.Y. 11217. The pattern of the zones to be removed by etching is developed by cutting and peeling out the red material, leaving the transparent film in the zones to be etched, and the red film in the zones of the metal to be retained. The artwork is then photographed to the exact size of the finished product. The metal blank to be photochemically machined is evenly coated with a photosensitive, etched-resistant material and the artwork image is then transferred by contact printing to the metal blank. The image is developed, and the zones to be etched are removed, leaving the zones not to be etched, such as the posts, rib segments, ledges and tabs covered with the photoresist. The blank is then sprayed with hot acid and the material not covered by the photoresist coating is dissolved under controlled conditions to produce a recessed section of desired depth.

Where, an element is to be etched from one side only, as in the annulus 11, the reverse side is suitably protected, as by coating it with a photoresist material. Where a blank is to have clear-through openings, such as inlet and outlet openings 54, or indicia, such as locators 58, the reverse side is also treated photochemically and developed and etched as above described.

After the annuli 11, 12 are prepared, the ledges, ribs and posts are provided with a brazing compound, such as BCu-1 or BNi-1 or BCu-P. The annuli 11, 12 are then placed in a confronting array and to precisely locate the corresponding confronting portions of annuli 11, 12. The thusly joined elements 11 and 12 are then conveyed through a heated tunnel, in which the brazing compound is activated, thereby serving to integrate the annuli and to produce the fluid passageway P in the zone of the fluid flow recesses through which fluid is adapted to flow between the inlet and outlet openings 54. Joining of the annuli in this manner avoids scaling.

Following joining of the annuli to produce the intermediate of FIG. 2, a portion or all of the joined locating and fixturing tabs 32, 52 are removed, as with a suitable cutting tool, and the heat exchanger is ready to be joined with nipples 16, 18 or other means for securing the heat exchanger to conduits C for conveying fluid to and from the openings 54.

The heat exchanger 10 is flat and retains the flatness of the annuli. It is sealed along its peripheries 13, 14. The joined arcuate rib segments 26, 46 and 28, 48 provide enhanced skeletal strength which becomes of greater importance when the thickness of the annuli and passageway is reduced or when the material of which the heat exchanger is formed is softer than steel. The passageway is of great precision, both as to shape and volume, as well as to flow characteristics provided by the selected internal configuration.

In the case of the embodiment of FIGS. 1–8, a blank having an external dimension of about 5.75 inch may be used. A single blank may be used or a pattern of blanks on a larger metal sheet providing, after etching, a plurality of annuli may be used. The external diameters of the annuli at the base of the locating tabs is about 5.06 inches and the diameters of the central openings are about 3.18 inches. The width of the passageway is about 0.625 inches. The thickness of the blank (i.e., thickness of the posts, ledges, ribs, etc.) is about 0.0625 inch and the depth of each of the recessed sections is about 0.040 inch which means that the depth of the passageway is about 0.080 inch. The metal used in the embodiment illustrated is type 302 stainless steel. Of course other materials, such as copper or copper based alloys, low-carbon high carbon and other stainless steels may be used, as well as aluminum and other metals. The thickness of the finished heat exchanger may vary from as much as 0.125 inch to as little as 0.025 inch, or even less.

With the photochemical machining techniques used, very thin heat exchangers of great precision may be prepared, while retaining the flatness and planarity of the metal blanks used.

It is to be understood that the external and internal configuration of the heat exchanger may vary with the needs and dictates of the designer and the environment to be cooled. For example, as shown in FIG. 9, a heat exchanger 100 having multiple openings 102 may be formed by the same process and technique. The heat exchanger 100 is designed to be used with a circuit board mounting a like plurality and array of transistor assemblies which requires cooling. The sizes and arrangement of the openings 102 is such that the exchanger may be positioned to receive the transistor assemblies, to assist in cooling the transistors and surrounding environment. In each case the opening is surrounded by a pair of internal peripheral boundaries which are sealed, as by brazed confronting ledges like ledges 22, 42 which produce an internal periphery 104, as by brazed confronting ledges, like ledges 24, 44 which produce an external periphery 103. Connecting posts and reinforcing means, similar to ribs 26, 28, 46, 48, may be located internally as necessary. Locating means, shown in dotted line as locating and fixturing tabs 110 may be used in the same manner as described above. Inlet and outlet openings 112 are in flow communication with suitable conduits and with the passageway 113 internally of the heat exchanger.

As shown in FIG. 10, a passageway formed internally of a heat exchanger of this invention may be of a maze type or multiple pass, as distinguished from the single pass arrangement suggested by FIGS. 1–8. Thus the heat exchanger annulus 200 of FIG. 10 is seen to comprise a maze or substantially a two-pass recessed section 202 extending between inlet opening 204 and outlet opening 206, with an internal ledge or rib 208 serving to separate one pass from the next.

Additionally, it is possible to provide for other means than nipples 16, 18 and openings 54 for introducing fluid to and removing fluid from the passageway P. For example, the external ledges 24, 44 may be provided with etched out zones so that the fluid will pass radially outwardly therethrough. In that case suitable fittings welded or otherwise secured thereto may be provided for connection to supply conduits C. Further, it is apparent that one etched-out element or annulus may be used with an unetched flat plate to provide a passageway formed by the single etched element. Similarly, it is apparent that stacked exchangers may be made by providing a flat plate between a pair of etched elements, one confronting each face of the flat plate. Alternatively, a central plate may be etched on one or both sides to cooperate with complementary facing plates. Other stacked arrangements or sandwich arrangements may be used as well and may be integrated in the manner disclosed herein.

It will be apparent to those skilled in the art that further modifications may be made without departing from the spirit and scope of the present invention. Accordingly, the invention is not to be construed as being limited to the embodiments illustrated and described, except as may be made necessary by the claims.

What is claimed is:

1. A thin, flat heat exchanger of a thickness of no more than about one-eighth inch comprising a flat photochemically etched first thin, flat element having a first surface defining elevated first peripheral boundary portions surrounding a first etched-out recess, a second thin, flat element confronting said first element and being sealingly secured to said first peripheral boundary portions to define a fluid passageway including said first etched-out recess, first and second fluid openings defined by said elements and providing an inlet to, and an outlet from, said passageway, and means integral with at least one of said elements and in contact with the other element located in said passageway for maintaining the skeletal stregth of said passageway and the structural integrity of said heat exchanger, and wherein said second element is photochemically etched to provide a second surface defining elevated peripheral boundary portions surrounding a second etched-out recess, and wherein said first and second peripheral boundary portions are complementary to define a fluid passageway which includes said first and second etched-out recesses, wherein said integral means includes complementary members projecting towards each other from each of said first and second thin flat members, and wherein said integral means further comprise post means defining a zone in which said heat exchanger may be drilled through without affecting the fluid tight integrity thereof, said post means being drilled to receive a fastener for securing said heat exchanger to an assembly to be cooled.

2. A thin, flat heat exchanger comprising a flat photochemically etched first thin, flat element having a first surface defining elevated first peripheral boundary portions surrounding a first etched-out recess, a second thin, flat element confronting said first element and being brazed to said first peripheral boundary portions to define a fluid passageway including said first etched-out recess, first and second fluid openings defined by said elements and providing an inlet to, and an outlet from, said passageway, means integral with at least one of said elements and in contact with the other said element located in said passageway for maintaining the skeletal strength of said passageway and the structural integrity of said heat exchanger, locating means for locating said first and second elements relative to each other, and for facilitating brazing of said elements to each other, and at least one opening therethrough to receive an element of an assembly to be cooled, said peripheral boundary portions being disposed around said opening, and wherein said locating means comprise projecting complementary tabs integral respectively with each of said elements, and wherein the tabs of the first element are welded to tabs of said second element, and wherein said second element is photochemically etched to provide a second surface defining elevated second peripheral boundary portions surrounding a second etched-out recess, and wherein said first and second peripheral boundary portions are complementary to define a fluid passageway which includes said first and second etched-out recesses, and wherein said integral means includes complementary members projecting towards each other from each of said first and second thin flat elements, and wherein said integral means comprise post means defining a zone in which said heat exchanger may be drilled through without affecting the fluid tight integrity thereof, and wherein said post means is drilled to receive a fastener for securing said heat exchanger to an assembly to be cooled.

3. A thin, flat heat exchanger in accordance with claim 1, and wherein said heat exchanger is no more than about one-eighth inch in thickness.

* * * * *